US005289602A

United States Patent [19]

Trader

[11] Patent Number: 5,289,602

[45] Date of Patent: Mar. 1, 1994

[54] WATER MATTRESS LINING AND SHEETING SYSTEM

[76] Inventor: Edward A. Trader, 849 Valley La., Riverside, Mo. 64150

[21] Appl. No.: 2,273

[22] Filed: Jan. 8, 1993

[51] Int. Cl.[5] ..... A47C 27/08; A47C 21/02

[52] U.S. Cl. ..... 5/451; 5/923

[58] Field of Search ..... 5/451, 923, 450, 452

[56] References Cited

U.S. PATENT DOCUMENTS

| | | | |
|---|---|---|---|
| 1,972,919 | 7/1932 | Chambless . | |
| 2,254,423 | 8/1939 | Gerry . | |
| 2,789,292 | 5/1955 | Budinquest . | |
| 2,907,055 | 2/1957 | Berman . | |
| 3,083,378 | 1/1961 | Pursell . | |
| 3,134,110 | 5/1964 | Gamichon . | |
| 3,443,294 | 5/1969 | George . | |
| 3,530,487 | 9/1970 | Beer . | |
| 3,570,026 | 3/1971 | Allison . | |
| 4,040,133 | 8/1977 | Gilreath | 5/451 |
| 4,301,561 | 11/1981 | McLeod | 5/451 |
| 4,488,323 | 12/1984 | Colburn | 5/496 |
| 4,731,998 | 2/1983 | Callaway | 5/451 |
| 4,809,375 | 3/1989 | Bull | 5/470 |
| 4,916,766 | 4/1990 | Grandy | 5/496 |
| 4,922,565 | 5/1990 | Blake | 5/496 |
| 4,979,251 | 12/1990 | Lazar | 5/496 |
| 5,003,655 | 4/1991 | Kafai | 5/496 |
| 5,144,707 | 9/1992 | Callaway et al. | 5/451 |

*Primary Examiner*—Alexander Grosz
*Attorney, Agent, or Firm*—Litman, McMahon & Brown

[57] ABSTRACT

A water mattress lining and sheeting system includes a water impervious liner which forms a compartment for holding a water-filled mattress, and a flat mattress covering. The mattress covering and liner are joined by a zipper at the top perimeter margin of the liner for easy access by a user. Alternatively, the covering may be zipped directly to the water mattress by means of a top perimeter flange integrally coupled to the mattress. For use of the system with a conventional mattress, a zipper track is attached to the perimeter margin of three sides of the mattress. A mattress cover is similarly provided on three sides with a zipper track and a cuff depends from the remaining side for receiving the zipperless side of the mattress.

6 Claims, 1 Drawing Sheet

WATER MATTRESS LINING AND SHEETING SYSTEM

BACKGROUND OF THE INVENTION

1. Field of the Invention

The present invention is broadly concerned with an improved water bed liner and sheeting system having a liner coupled with a sheet or other mattress covering for quick, easy removal and replacement of the covering. More particularly, it is concerned with a system having a water impervious liner fitted with a zipper track around its perimeter and a sheet having a zipper track fitted around its perimeter so that the liner and the sheet may be easily coupled at the top perimeter of the mattress without the need for tucking the sheet under the corners of the water mattress. Alternatively, one zipper track may be integrally attached to the upper perimeter of the mattress for coupling with the sheet. In other embodiments for use with a conventional mattress, a zipper track is integrally attached to three sides of the perimeter of a mattress for engagement with a zipper track extending along three sides of a mattress cover, and a cuff depends from the remaining side of the cover for receiving the remaining side of the mattress.

2. Description of the Related Art

Prior art mattress covering systems employed flat or fitted bottom sheets which were tucked under the sides and corners of the mattress to present a smooth sleeping surface. Installation of such sheets required lifting the corners of the mattress to tuck the sheets in place. Such sheets are difficult to install in tight situations such as berths in yachts and trucks, baby cribs, and even in conventional rooms where the bed is placed against a wall or in a corner. In the case of water-filled mattresses, the weight of even a corner of the mattress virtually precludes effective tucking of the sheet. Since the sheets cannot be effectively secured in place by tucking, the sleeping surface frequently presents a rumpled appearance and the sheets may even become completely loosened and tangled. Moreover, such a bunched sheeting surface is substantially less comfortable than a smooth surface for the sleeper.

A number of mattress covering systems have been proposed to address this problem. U.S. Pat. No. 4,301,561 issued to McLeod discloses an underliner for installation between the liner and the mattress. The underliner has velcro strips for attachment to a sheet having side panels which extend downwardly along the sidewalls and endwalls of the mattress. This system would thus require insertion of the hands between the water mattress and the frame in order to fasten and unfasten the sheet. A number of systems have been developed for use with conventional mattresses, but such systems generally cannot be employed with water mattresses because of the great weight of the mattress when filled. U.S. Pat. No. 3,083,378 issued to Pursell and U.S. Pat. No. 2,907,055 issued to Berman disclose fitted sheets for conventional mattresses having side panel zippers; U.S. Pat. No. 4,809,375 issued to Bull and U.S. Pat. No. 3,530,487 issued to Beer disclose conventional mattresses having zippers joined to the upper and lower mattress welting respectively for joining to a sheet or other mattress covering. U.S. Pat. No. 1,972,919 issued to Chambless discloses a sheet for conventional mattresses having a pocket with a side panel zipper.

SUMMARY OF THE INVENTION

The present invention overcomes the problems previously outlined and provides a greatly improved water mattress lining and sheeting system which permits quick and easy removal and replacement of a sheet or other mattress covering.

Broadly speaking, the system includes a water impervious liner which forms a compartment for holding a water-filled mattress, and a flat mattress covering. The covering and liner are joined by a zipper at the top perimeter margin of the liner for easy access by a user. In particularly preferred forms, the covering is zipped directly to the water mattress by means of a zipper track joined to a top perimeter flange integrally coupled to the mattress. In still other embodiments, a zipper track is attached to the bottom perimeter margin of three sides of a conventional mattress. A mattress cover is similarly provided on three sides with a zipper track and a cuff depends from the remaining side for receiving the zipperless side of the mattress.

OBJECTS AND ADVANTAGES OF THE INVENTION

The principal objects and advantages of the present invention include: providing a water mattress lining and sheeting system which permits easy removal and replacement of the sheet without the need for lifting the corners of the water mattress and tucking the sheet under them; providing such a system which permits replacement of the sheet without the need for tucking the sheet between the mattress and a frame; providing such a system which couples a removable sheet to the top perimeter of a water impervious waterbed liner; providing such a system which couples a removable sheet directly to the top surface of a water mattress; providing such a system in which the sheet is held securely in place and will not bunch or become untucked during use; providing such a system in which the sheet is coupled in place by a zipper; providing such a system which a multilayer mattress covering is employed; providing such a system in which the mattress covering is tailored to fit the mattress top and is removably fastened at the top perimeter so that extension over the sides and beneath the mattress is not required; providing such a sheeting system which minimizes the amount of fabric mattress covering and concomitant laundry space required; providing such a sheeting system for a conventional mattress.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

Figure 1:
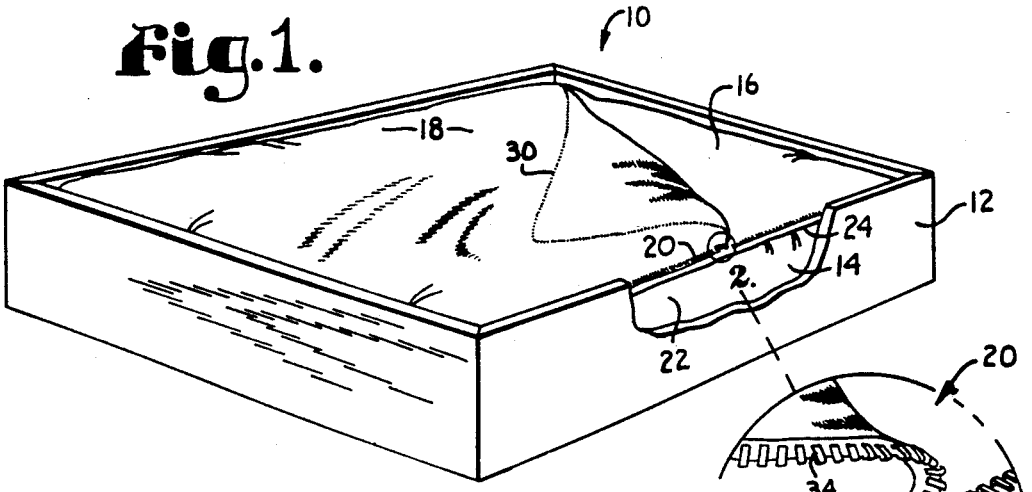
FIG. 1 is a perspective view of the water mattress lining and sheeting system of the invention depicting a sheet coupled with a water mattress liner.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

I. Introduction and Environment

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring now to the drawing, water mattress lining and sheeting system 10 in accordance with the invention broadly includes a generally rectangular wooden frame 12, a water impervious liner 14, a water-filled mattress 16, a mattress covering 18 and zipper coupling 20.

Figure 2:
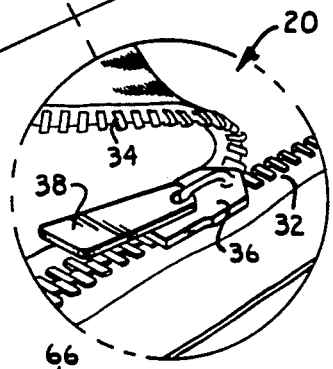
FIG. 2 is an enlarged detail of the zipper coupling generally shown within circle 2 in FIG. 1.
Figure 3:
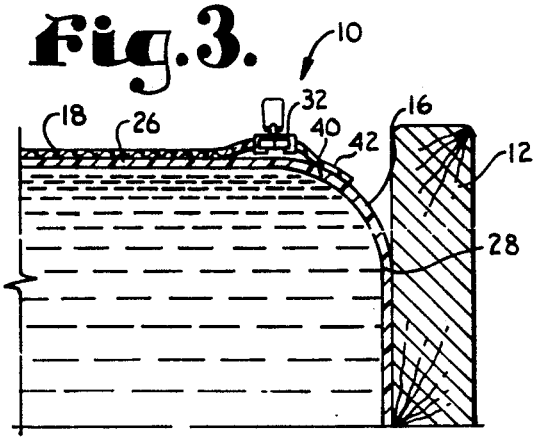
FIG. 3 is a sectional view of an alternate embodiment similar to that shown in FIG. 1, depicting a sheet attached directly to a flange integrally coupled with a water mattress.

In more detail, lining and sheeting system 10 includes a liner bottom portion (not shown) and liner sidewalls 22, presenting a perimeter margin 24. As best shown in FIGS. 1-3, mattress 16 includes a top 26, bottom (not shown), and sidewalls 28. Mattress covering 18 is tailored to fit mattress top surface 26 and includes a perimeter margin 30. Zipper coupling 20 is constructed of two tracks 32, 34 which are coupled with liner margin 24 and mattress covering margin 30 respectively, and which are interdigitated by drawing a centerpiece 36 forwardly along the tracks using a handle 38.

In especially preferred embodiments depicted in FIG. 3, zipper track 32 is coupled directly to water mattress 16 rather than to liner 14. Water mattress top surface 26 includes a perimeter margin 40 having a flange 42 for coupling with zipper track 32. Flange 42 and water mattress 16 are be constructed of the same or like materials, preferably of synthetic resinous materials such as vinyl, polyethylene, or other water impervious material, and are integrally coupled by fusion welding or similar method. In other preferred forms, flange 42 is formed as an integral part of the construction of water mattress 16.

Figure 5:
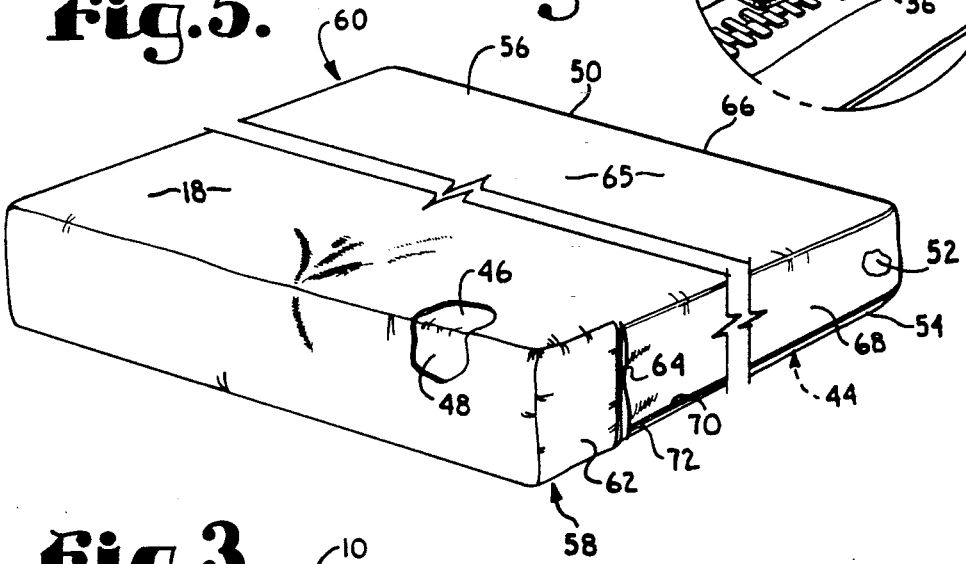
FIG. 5 is a perspective view of an alternate embodiment for use with a conventional mattress.

A conventional mattress may also be employed in the embodiments depicted in FIGS. 1 and 3. Still other preferred embodiments employing a conventional mattress are depicted in FIG. 5. A conventional mattress 44, includes top 46 and bottom (not shown) surfaces, a head 48, foot 50, and sidewalls 52, presenting a margin 54 extending along the bottom perimeter. A mattress covering 56 includes first and second portions 58, 60. First covering portion 58 includes a cuff structure 62 which extends over mattress head 48. Cuff 62 includes an elastic band 64 to maintain its shape and provide for a snug fit over mattress 44. Second covering portion 60 includes a top surface 65, a foot 66 and a pair of side portions, 68 coupled with a zipper track 70 which extends along the bottom perimeter margins of foot 66 and side portions 68. A zipper track 72 extends along mattress bottom perimeter margin 54 along mattress foot 50 and sidewalls 52 for mating engagement with track 70.

Still other preferred embodiments for use with a conventional mattress employ a mattress covering 5 having an essentially planar second portion 60 coupled with zipper track 70. In such embodiments zipper track 72 extends along mattress top perimeter margin for mating engagement with track 70.

Liner 14 may also be employed with a conventional mattress, in which case mattress covering 56 is coupled directly with liner 14 rather than with mattress perimeter 54.

Water mattress 16 is of conventional construction consisting of a water-filled bladder, although the sheeting system of the present invention may also be employed with water-filled mattresses having internal baffles or with foam and water mattresses. Liner 14 is of conventional, water-impervious construction to protect against leakage in the event of a rupture in mattress 16.

Figure 4:
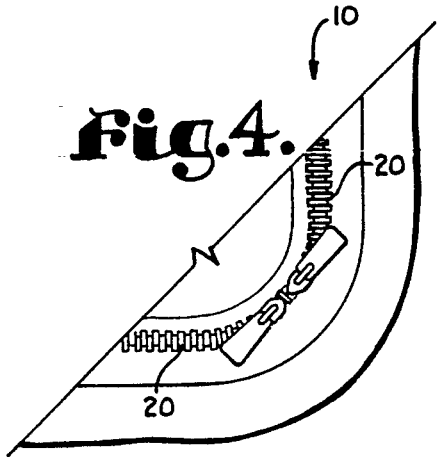
FIG. 4 is a fragmentary top plan view of the embodiment depicted in FIG. 1, showing use of a pair of zippers.

Zipper tracks 32, 34, and 70, 72 are preferably of nylon coil construction, although they may also be formed with tracks of toothed metal or any other suitable material. A single zipper unit may be employed as depicted in FIG. 1, or a pair of zippers may be employed to close at a corner, as depicted in FIG. 4, or the zippers may meet at any point along the head, foot, or sidewall margins. Zipper tracks 32 and 72 may be coupled with liner 14, flange 42 or mattress perimeter margin 54 by any suitable method such as gluing, adhesive bonding, fusion welding, or sewing. Those skilled in the art will appreciate that other coupling means such as buttons, snaps, hook and loop fasteners may be employed in lieu of zippers.

Mattress coverings 18 and 56 may be of single layer construction such as a percale or muslin sheet, or they may be of multi-layer construction including a bottom layer of water-impervious material, one or more middle layers of cotton, wool, or synthetic padding for softness, and a top sheeting layer. In still other embodiments especially suitable for use on baby cribs, multiple zipper tracks may be provided for separately fastening several different mattress coverings.

Frame 12 is preferably constructed of wood, metal, or any other material with sufficient strength to maintain the shape of the water filled mattress.

For use on conventional mattresses in berths on yachts, trucks, vans, or other close quarters of unusual configuration the mattress covering may be constructed so as to place the cuff at the head, foot, or side of the mattress.

In use, a mattress covering 18 such as a sheet is placed on water mattress 16 so that zipper track 34 engages zipper track 32 (which may be attached to liner 14, or directly to water mattress 16). A user grasps handle 38 and draws centerpiece 36 along the zipper around perimeter margin 30 to firmly fasten mattress covering 18 in place. Since sheet 18 is tailored to fit mattress top 26 and does not extend along mattress sidewalls 28 it is not necessary for a user to tuck any portion either underneath mattress 16 or between mattress sidewalls 28 and frame 12. To change covering 18, the process is reversed and the covering is unzipped for replacement.

In the case of a conventional mattress 44 a user grasps mattress covering cuff 62 and slips it over mattress head 48. Elastic 64 at the margin engages mattress 44 to prevent slippage. Mattress covering 56 is placed on conventional mattress 44 so that zipper track 70 engages zipper track 72 and centerpiece 36 is drawn along the zipper to firmly secure covering 56 in place at the perimeter margins of foot 66 and side portions 68. In other embodiments, mattress covering 56 is placed on mattress so that zipper track 70 engages liner track 32.

It is to be understood that while certain forms of the present invention have been illustrated and described herein, it is not to be limited to the specific forms or arrangement of parts described and shown.

What is claimed and desired to be secured by Letters Patent is as follows:

1. In a water bed system including a water mattress with substantially horizontal top and bottom surfaces interconnected by a substantially vertical side portion, said mattress being positioned in a base receptacle, the improvement comprising:

(a) a resilient base receptacle liner having bottom and sidewalls defining a mattress-holding compartment, and a top perimeter margin, said top perimeter margin contacting and partially overlying a portion of the top surface of said mattress;

(b) a mattress covering in covering relationship to the remainder of said top portion of said mattress inside of said top perimeter margin and presenting a perimeter margin; and (c) means continuously coupling the perimeter margin of said liner with the perimeter margin of said mattress covering.

2. The improved waterbed system as set forth in claim 1, wherein said coupling means includes a zipper.

3. The improved waterbed system as set forth in claim 1, wherein said base receptacle liner is water impervious.

4. A water mattress sheeting system comprising:

(a) a water mattress with substantially horizontal top and bottom surfaces interconnected by a substantially vertical side portion, said water mattress presenting an integral top perimeter flange, said top perimeter flange being positioned on and extending continuously about the perimeter of said mattress top portion, said flange including a first coupling means;

(b) a mattress covering in covering relationship to the remainder of said mattress top portion inside of said top perimeter flange, and presenting a perimeter margin, said perimeter margin extending about the perimeter of said mattress covering and including a second coupling means; and (c) means connecting said first and second coupling means whereby said mattress covering and said mattress top perimeter flange are coupled about the perimeter of said mattress covering.

5. The sheeting system as set forth in claim 4, wherein said said first coupling means extends continuously along said mattress top flange and said second coupling means extends continuously along said mattress covering perimeter.

6. The sheeting system as set forth in claim 4, wherein said connecting means includes a zipper.

* * * * *